US008333571B2

(12) United States Patent
Mehta et al.

(10) Patent No.: US 8,333,571 B2
(45) Date of Patent: Dec. 18, 2012

(54) PUMP HAVING PULSATION-REDUCING ENGAGEMENT SURFACE

(75) Inventors: Viral S. Mehta, Peoria, IL (US); Bryan E. Nelson, Lacon, IL (US)

(73) Assignee: Caterpillar Inc., Peoria, IL (US)

( * ) Notice: Subject to any disclaimer, the term of this patent is extended or adjusted under 35 U.S.C. 154(b) by 680 days.

(21) Appl. No.: 12/314,574

(22) Filed: Dec. 12, 2008

(65) Prior Publication Data

US 2010/0150747 A1 Jun. 17, 2010

(51) Int. Cl.
*F04B 1/12* (2006.01)
*F04B 27/08* (2006.01)

(52) U.S. Cl. ..... 417/269; 92/71

(58) Field of Classification Search ..... 92/71; 417/269, 417/53, 221.1; 74/60
See application file for complete search history.

(56) References Cited

U.S. PATENT DOCUMENTS 3,261,227 A * 7/1966 Lomnicki ..... 74/567
3,287,993 A * 11/1966 Lomnicki ..... 74/567
RE26,519 E * 1/1969 D'Amato ..... 91/505
4,615,257 A 10/1986 Valentin
4,753,581 A * 6/1988 Hiscock ..... 417/539
5,358,388 A * 10/1994 Schutten et al. ..... 417/269
5,423,797 A 6/1995 Adrian et al.
5,644,949 A 7/1997 Murakami et al.
5,794,515 A 8/1998 Bethke
5,836,160 A * 11/1998 Chang ..... 60/489
5,868,556 A 2/1999 Umemura
6,045,342 A 4/2000 Kimura
6,079,313 A * 6/2000 Wolcott et al. ..... 92/71
6,123,009 A * 9/2000 Kanayama et al. ..... 92/71
6,152,702 A * 11/2000 Codina et al. ..... 417/63
6,174,139 B1 * 1/2001 Stolzer ..... 417/222.1
6,192,784 B1 2/2001 Kato et al.
6,234,758 B1 * 5/2001 Pawelski ..... 417/26
6,354,812 B1 * 3/2002 Todd ..... 417/269
6,406,271 B1 * 6/2002 Valentin ..... 417/269
6,412,171 B1 7/2002 Kato et al.
6,468,046 B1 * 10/2002 Du et al. ..... 417/222.1
6,543,333 B2 4/2003 Griffin et al.
6,570,298 B2 * 5/2003 Yasuda ..... 310/328
6,694,864 B2 2/2004 Kato et al.
6,697,741 B2 * 2/2004 Yu et al. ..... 702/33
6,823,768 B2 11/2004 Tagami
6,837,141 B1 * 1/2005 Edelson ..... 91/491

(Continued)

OTHER PUBLICATIONS

Oberg, E.; Jones, F.D.; Horton, H.L.; Ryffell, H.H. (2000). Machinery's Handbook (26th Edition). (pp. 697-710). Industrial Press. Online version available at: http://www.knovel.com/web/portal/browse/display?_EXT_KNOVEL_DISPLAY_bookid=309&VerticalID=0.*

*Primary Examiner* — Devon Kramer
*Assistant Examiner* — Joseph Herrmann
(74) *Attorney, Agent, or Firm* — Finnegan, Henderson, Farabow, Garrett & Dunner LLP

(57) ABSTRACT

A pump is disclosed. The pump may have a housing, and a body disposed within the housing and at least partially defining a plurality of barrels. The pump may also have a plurality of plungers associated with the plurality of barrels, and a plunger engagement surface. The plunger engagement surface may have geometry configured to reciprocate the plurality of plungers within the plurality of barrels as the plurality of plungers rotate relative to the plunger engagement surface, and a plurality of undulations configured to reduce a flow pulsation of the pump.

18 Claims, 6 Drawing Sheets

U.S. PATENT DOCUMENTS

| | | | | |
|---|---|---|---|---|
| 7,063,003 | B2 | 6/2006 | Tagami | |
| 7,753,659 | B2 * | 7/2010 | Boyl-Davis et al. | 417/237 |
| 7,814,823 | B2 * | 10/2010 | Takahashi et al. | 91/505 |
| 2003/0000376 | A1 | 1/2003 | Sugiura et al. | |
| 2003/0063980 | A1 * | 4/2003 | Doll | 417/221 |
| 2004/0131473 | A1 * | 7/2004 | Lanfredi et al. | 417/222.1 |
| 2005/0084387 | A1 * | 4/2005 | Klocke | 417/221 |
| 2005/0276701 | A1 * | 12/2005 | Bowers et al. | 417/269 |
| 2006/0008358 | A1 | 1/2006 | Thoms et al. | |
| 2008/0193307 | A1 * | 8/2008 | Elata et al. | 417/474 |

* cited by examiner

PUMP HAVING PULSATION-REDUCING ENGAGEMENT SURFACE

TECHNICAL FIELD

The present disclosure relates generally to a pump and, more particularly, to a pump having a pulsation-reducing engagement surface.

BACKGROUND

Hydraulic tool systems typically employ multiple actuators provided with high-pressure fluid from a common pump. In order to efficiently accommodate the different flow and/or pressure requirements of the individual actuators, these systems generally include a pump having variable displacement. Based on individual and/or combined flow and pressure requirements, the pump changes a fluid displacement amount to meet demands. When demand is low, the displacement is reduced to conserve energy.

Typical variable displacement pumps used in hydraulic tool systems are known as axial plunger or swashplate-type pumps. This type of pump includes a plurality of plungers held against a plunger engagement surface of a tiltable swashplate. In most situations, the swashplate is generally planar and includes a smooth surface. A joint such as a ball and socket joint is disposed between each plunger and the engagement surface to allow for relative movement between the swashplate and the plungers. Each plunger is slidably disposed to reciprocate within an associated barrel as the plungers rotate relative to the tilted surface of the swashplate. As each plunger is retracted from the associated barrel, low pressure fluid is drawn into that barrel. When the plunger is forced back into the barrel by the plunger engagement surface of the swashplate, the plunger pushes the fluid from the barrel at an elevated pressure. In some situations, the tilt angle of the swashplate may be fixed such that the output of the pump is solely based on an input to the pump.

Another type of pump is known as a rotary plunger-type pump. This type of pump also includes a plurality of plungers held against a plunger engagement surface. In contrast to the swashplate-type pump, however, the plunger engagement surface of the rotary plunger-type pump is located directly on a stroke ring of the pump's rotating shaft, and the plungers are oriented at a right angle relative to the rotating shaft (i.e., rotary plunger-type pumps do not include a swashplate). The stroke ring is offset relative to a rotational axis of the shaft such that, as the shaft of the pump rotates, the stroke ring forces the plungers to reciprocate relative to their barrels, thereby pressurizing fluid similar to that described above.

An exemplary swashplate-type pump is disclosed in U.S. Pat. No. 5,644,949 (the '949 patent) issued to Murakami et al. on Jul. 8, 1997. In the pump design of the '949 patent, pairs of longitudinally aligned cylinder bores are formed in two separate cylinder blocks, and are arranged about a shaft at equal angular intervals. A double headed plunger is reciprocatingly disposed in each pair of cylinder bores. A wave cam is fixed to the drive shaft and rotates integrally with the shaft. The wave cam has front and rear cam surfaces, each having a two-cycle undulated displacement curve defined thereon. During operation, the plungers are caused to reciprocate within their respective bores by rotation of the wave cam and the shape of the displacement curve. In this manner, the plungers can be made to displace a refrigerant without having to tilt or control tilt of the wave cam.

While the pump of the '949 patent may be suitable for refrigerant purposes, it may lack applicability to other situations. Specifically, because the wave cam is fixed to the drive shaft, tilting of the wave cam to vary displacement of the plungers may not be possible. And, fixed displacement pumps may find limited application in, for example, machine hydraulic, lubrication, coolant, or fuel system arrangements. Further, the wave cam may induce undesired flow pulsations within the refrigerant flow. Lastly, the wave cam of the '949 patent may provide little benefit to a rotary plunger type pump The disclosed pump is directed to overcoming one or more of the problems set forth above.

SUMMARY OF THE INVENTION

In one aspect, the present disclosure is directed to a pump. The pump may include a housing, and a rotatable body disposed within the housing and at least partially defining a plurality of barrels. The pump may also include a plurality of plungers associated with the plurality of barrels, and a plunger engagement surface. The plunger engagement surface may have geometry configured to engage and vary a displacement of the plurality of plungers within the plurality of barrels as the plurality of plungers rotate relative to the plunger engagement surface, and a plurality of undulations configured to reduce a flow pulsation of the pump.

In another aspect, the present disclosure is directed to a pump. The pump may include a housing, a rotatable body disposed within the housing and at least partially defining a plurality of barrels, and a plurality of plungers associated with the plurality of barrels. The pump may also include a stationary base disposed within the housing and being tiltable to vary a displacement of the plurality of plungers within the plurality of barrels, and a wear plate disposed between the stationary base and the plurality of plungers. The pump may further include at least one actuator located between the base and the wear plate to selectively separate a portion of the wear plate from the base and induce undulations in plunger movement that reduce a flow pulsation of the pump.

In another aspect, the present disclosure is directed to a swashplate for a pump having a plurality of plungers. The swashplate may include a plunger engagement surface, and a base having a tilt axis about which the plunger engagement surface may be tiltable to vary a displacement of the pump. The swashplate may also include a plurality of undulations formed on the plunger engagement surface to reduce a flow pulsation of the pump.

In yet another aspect, the present disclosure is directed to a method of pressurizing fluid. The method may include reciprocating a plurality of plungers to produce a flow of pressurized fluid, and adjusting a displacement of the plungers to vary a rate of fluid pressurizing. The method may also include inducing undulations in movement of the plungers during reciprocation to reduce a pulsation in the flow of pressurized fluid.

DETAILED DESCRIPTION

Figure 1:
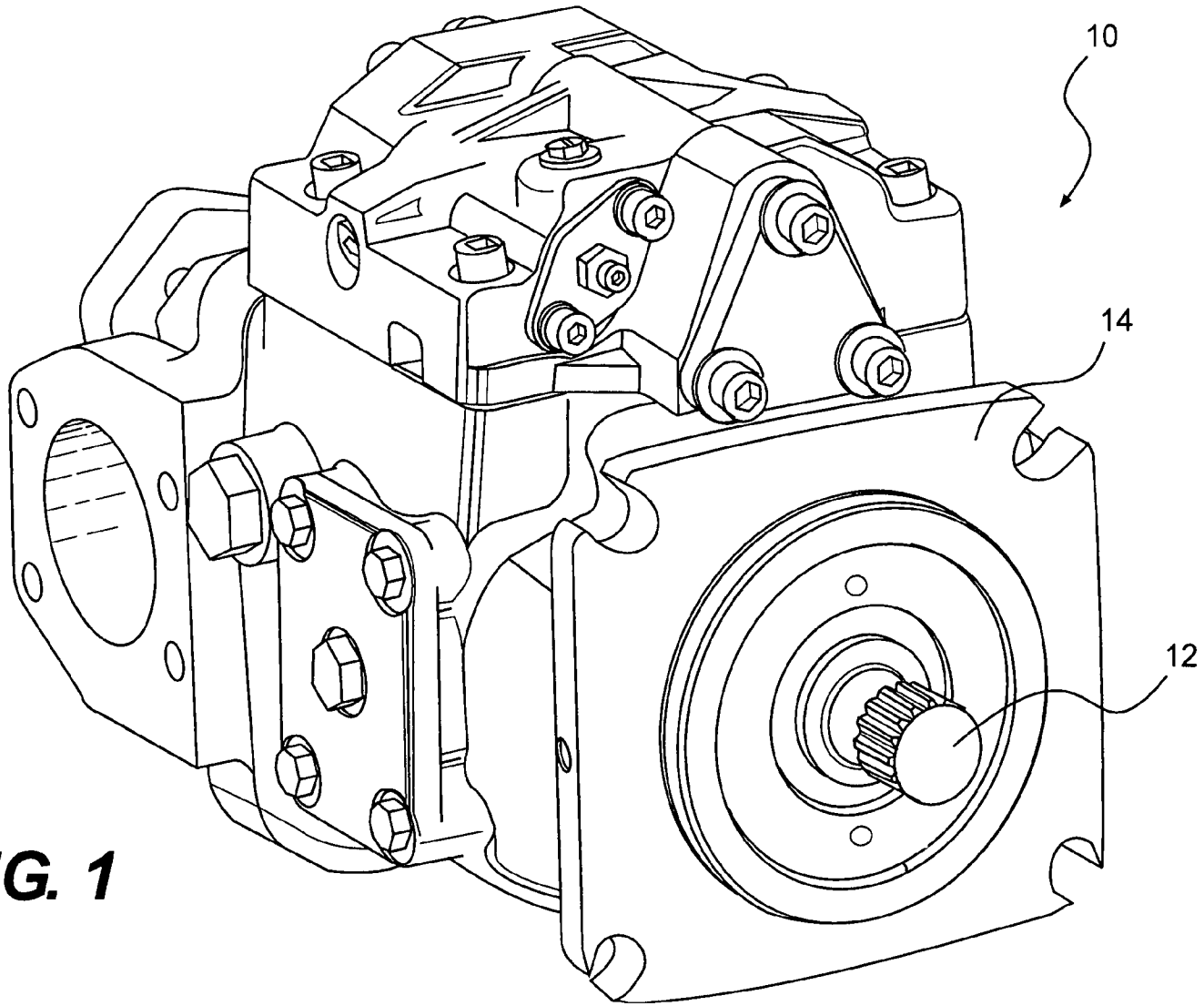
FIG. 1 is a diagrammatic illustration of an exemplary disclosed pump.

FIG. 1 illustrates a pump 10. In one embodiment, pump 10 may be driven by an external source of power (not shown), such as a combustion engine, via a driveshaft 12. As such, driveshaft 12 may extend from one end of a pump housing 14 for engagement with the engine.

Figure 2:
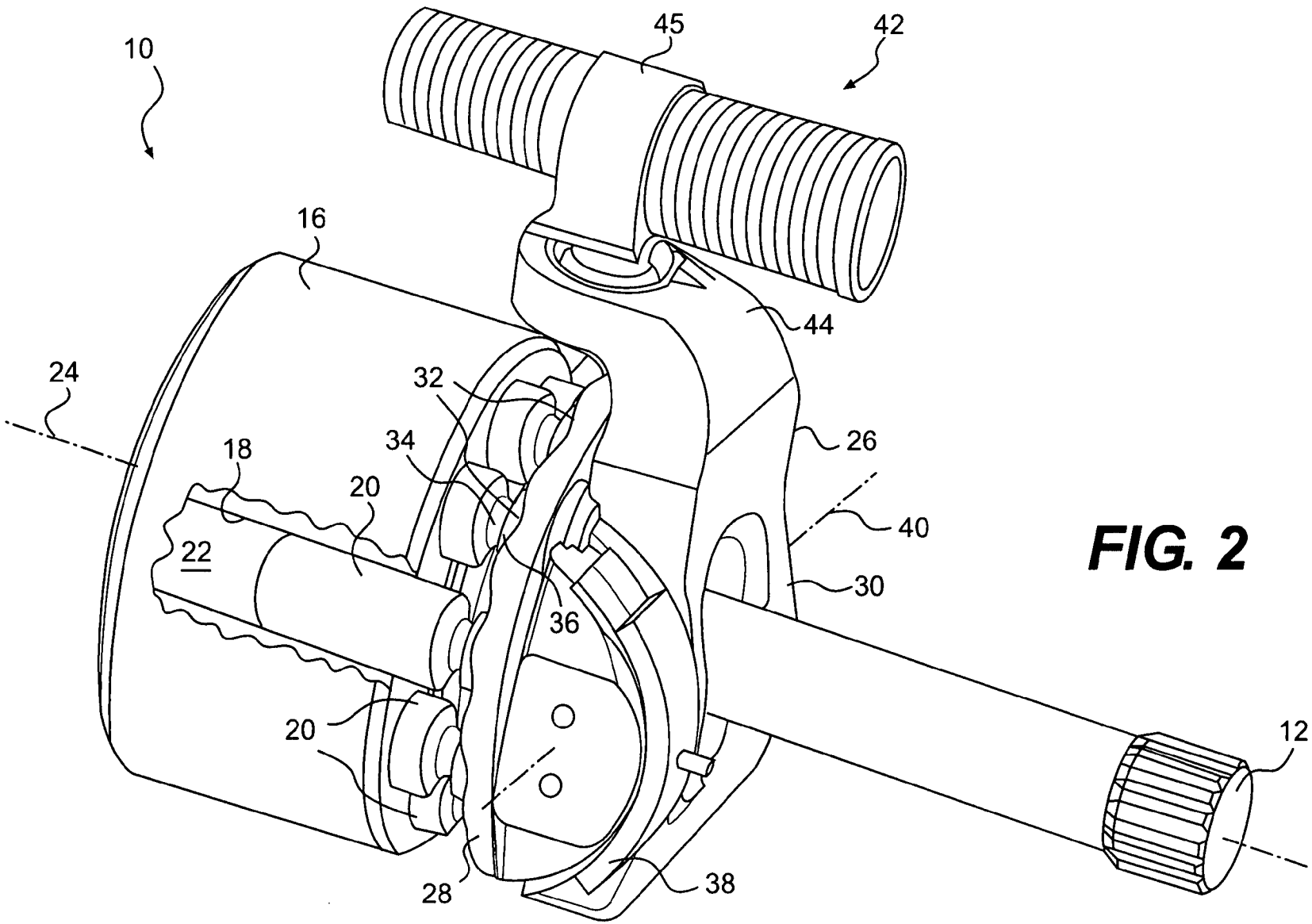
FIG. 2 is a cut-away view of the pump of FIG. 1.

As illustrated in FIG. 2, housing 14 may enclose a body 16 at least partially defining a plurality of barrels 18 (only one shown). Pump 10 may also include a plurality of plungers 20, one plunger 20 slidingly disposed within each barrel 18. Each barrel 18 and each associated plunger 20 may, together, at least partially define a pumping chamber 22. It is contemplated that any number of pumping chambers 22 may be included within body 16 and symmetrically and radially disposed about a central axis 24. In the embodiment of FIG. 2, seven pumping chambers 22 are included within body 16. Although central axis 24 is shown in FIG. 2 as being coaxial with driveshaft 12, it is contemplated that central axis 24 may be at an angle relative to driveshaft 12 such as in a bent-axis type pump, if desired.

Body 16 may be connected to rotate with driveshaft 12. That is, as driveshaft 12 is rotated by the engine or another external power source, body 16 and plungers 20 located within barrels 18 of body 16 may all rotate together about central axis 24. Alternatively, in some embodiments, driveshaft 12 may rotate independent of body 16, if desired.

Pump 10 of FIGS. 1-5 may be a swashplate-type pump. Specifically, pump 10 may include a generally stationary swashplate 26 having a plunger engagement surface 28 and a tiltable base 30. Plunger engagement surface 28 may be located between plungers 20 and tiltable base 30 to operatively engage plungers 20 by way of a joint 32 such as a ball and socket joint. That is, each plunger 20 may have a generally spherical end 34, which may be biased into engagement with a cup-like socket 36. Sockets 36 may be configured to slide along plunger engagement surface 28, which may be fixedly connected to or otherwise integral with tiltable base 30. In an alternative embodiment, swashplate 26 may rotate together with driveshaft 12, while body 16 and plungers 20 remain stationary.

Swashplate 26 may be tilted to vary a displacement of plungers 20 within barrels 18. Specifically, tiltable base 30 may be situated within a bearing member 38 and pivotal about a tilt axis 40. In one embodiment, tilt axis 40 may pass through and be substantially perpendicular to central axis 24. As tiltable base 30 and connected plunger engagement surface 28 pivot about tilt axis 40, the plungers 20 located on one half of plunger engagement surface 28 (relative to tilt axis 40) may retract into their associated barrels 18, while the plungers 20 located on an opposing half of plunger engagement surface 28 may extend out of their associated barrels 18 by about the same amount. As plungers 20 rotate about central axis 24, plungers 20 may annularly move from the retracted side of plunger engagement surface 28 to the extended side, and repeat this cycle as driveshaft 12 continues to rotate. It is contemplated that swashplate 26 may alternatively be fixed at a predetermined tilt angle, if desired.

As plungers 20 retract out of barrels 18, low-pressure fluid may be drawn into barrels 18. Conversely, as plungers 20 extend into barrels 18, the fluid may be forced from barrels 18 at an elevated pressure. An amount of movement between the retracted position and the extended position may relate to an amount of fluid displaced by plungers 20 during a single rotation of driveshaft 12. Because of the connection between plungers 20 and plunger engagement surface 28, the tilt angle of plunger engagement surface 28 (i.e., the angle relative to a perpendicular of central axis 24 that results in positive displacement of plungers 20) may relate to the movement between the retracted position and the extended position. One or more pressure relief valves (not shown) located within pump 10 or within a hydraulic circuit (not shown) supplied with fluid from pump 10, may affect the pressure of the fluid forced from barrels 18.

Swashplate 26 may be tilted about tilt axis 40 by way of an actuator 42. Actuator 42 may be disposed within a bore (not shown) of housing 14 and connected to tiltable base 30 by way of an arm 44 protruding from one side of tiltable base 30. Specifically, an actuator bracket 45 may be pivotally connected to protruding arm 44, and fixedly connected to actuator 42. Actuator 42 may translate linearly in the general direction of central axis 24 to pivot tiltable base 30 about tilt axis 40. For example, actuator 42 may move in a first direction away from an input end of driveshaft 12 to increase a tilt angle of plunger engagement surface 28. Conversely, actuator 42 may move in a second direction toward the input end of driveshaft 12 to decrease a tilt angle of plunger engagement surface 28. Actuator 42 may be powered in any conventional manner, including, among other ways, hydraulically, electrically, pneumatically, and mechanically. It is also contemplated that other actuator configurations may be used to tilt swashplate 26, if desired.

Figure 3:
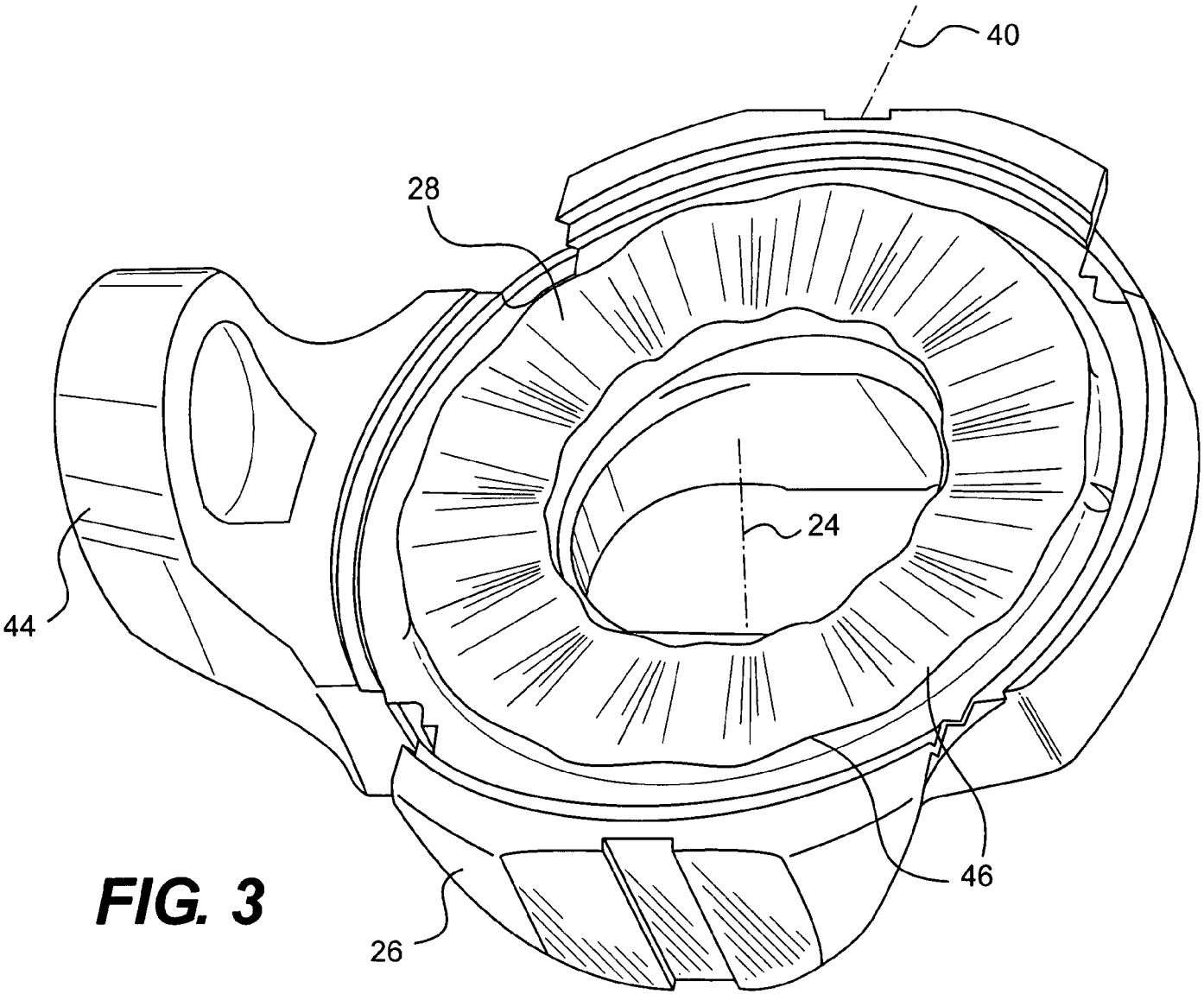
FIG. 3 is a diagrammatic illustration of an exemplary disclosed swashplate that may be used in conjunction with the pump of FIG. 1.

As shown in FIG. 3, plunger engagement surface 28 may include a plurality of annularly arranged undulations 46. Undulations 46 may embody pairs of generally sinusoidal crests and troughs in plunger engagement surface 28. The number of undulations 46 (i.e., the number of paired crests and troughs) formed in plunger engagement surface 28 may be related to the number of plungers 20 included within pump 10. For example, when the number of plungers 20 is odd, the number of undulations 46 may be equal to two times the number of plungers 20. When the number of plungers 20 is even, the number of undulations 46 may be equal to the number of plungers 20. Further, the amplitude of undulations 46 (i.e., the height of the crest from an annular mid-plane separating the crests from the troughs), may be related to a displacement capacity of plungers 20, a number of plungers 20 included within pump 10, and/or a rated operating speed of pump 10. For example, the amplitude of undulations 46 may be about equal to 70-500 μ for a 90-500 cc pump operating in a speed range of about 1500-2200 rpm.

Undulations 46 may be configured to reduce a flow pulsation of pump 10. Specifically, based on a number of plungers 20 included within pump 10 and a speed of pump 10, the flow of pressurized fluid exiting pump 10 may exhibit generally sinusoidal flow pulsations in velocity and/or pressure with respect to time, as well as resulting torque pulsations on body 16, swashplate 26, and driveshaft 12. These pulsations, if unaccounted for, could create instability in the associated hydraulic system and/or be observed as undesired noise stemming from pump 10. Undulations 46 may help to reduce the flow pulsations and the associated instability and noise, by instantaneously changing plunger travel by a specific amount that pertains to the design of pump 10. These instantaneous changes in plunger travel may be designed to attenuate or even cancel the above-described flow pulsations. In some examples, undulations 46 have been shown to substantially attenuate the first three harmonics associated with the flow pulsations.

Figure 4:
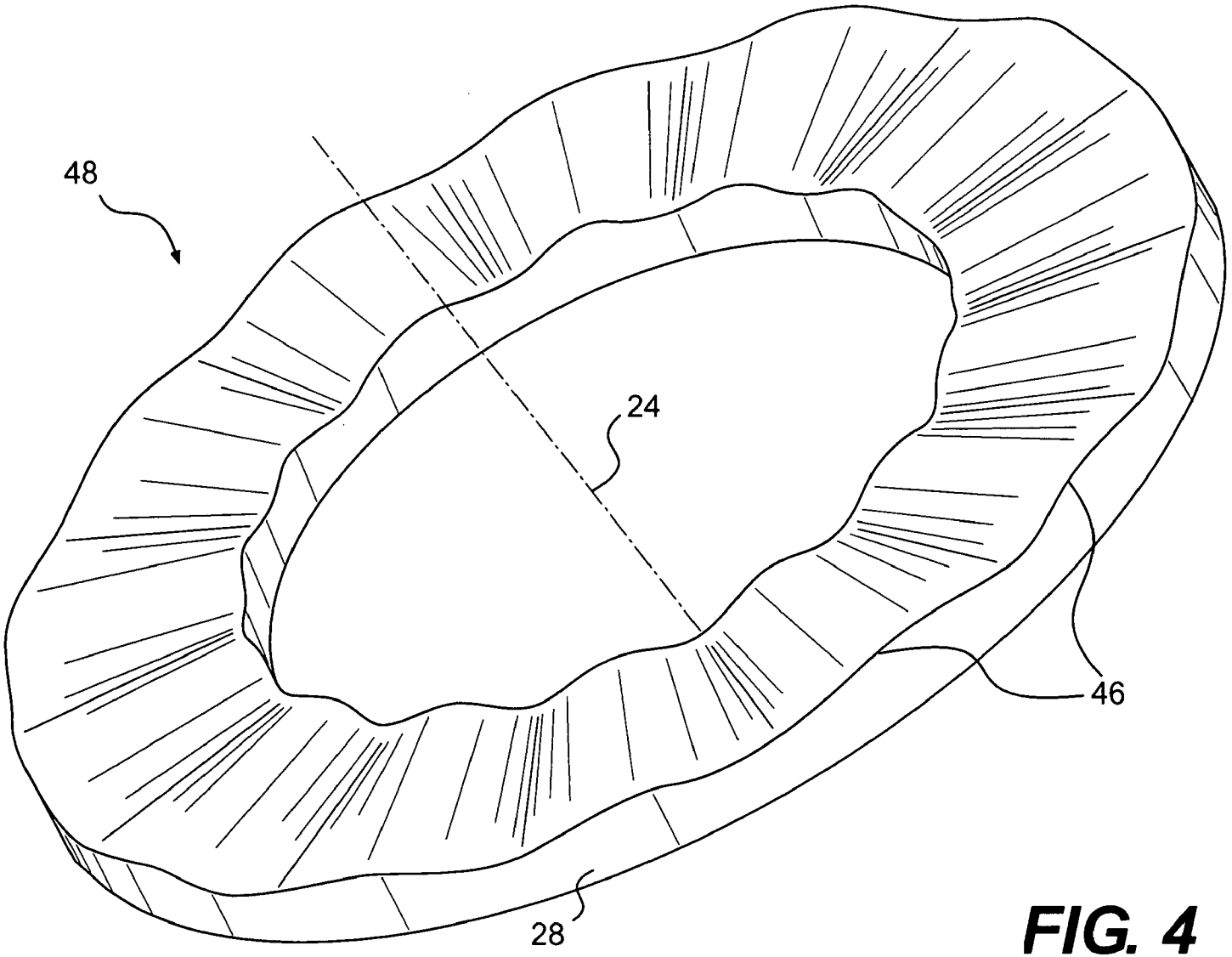
FIG. 4 is a diagrammatic illustration of an exemplary disclosed wear plate that may be used in conjunction with the pump of FIG. 1.

FIG. 4 illustrates an alternative embodiment of swashplate 26, wherein plunger engagement surface 28 is separate from tiltable base 30 (not shown in FIG. 4). Specifically, plunger engagement surface 28 may be included on a wear plate 48, which may be a separate component from tiltable base 30. In this arrangement, wear plate 48 may still remain stationary together with tiltable base 30 during operation of pump 10. By utilizing separate components, fabrication of plunger engagement surface 28 may be simplified, while service costs associated with swashplate 26 may be reduced. That is, when undulations 46 have worn significantly, only wear plate 48 may require replacement, rather than the entire swashplate 26.

Figure 5:
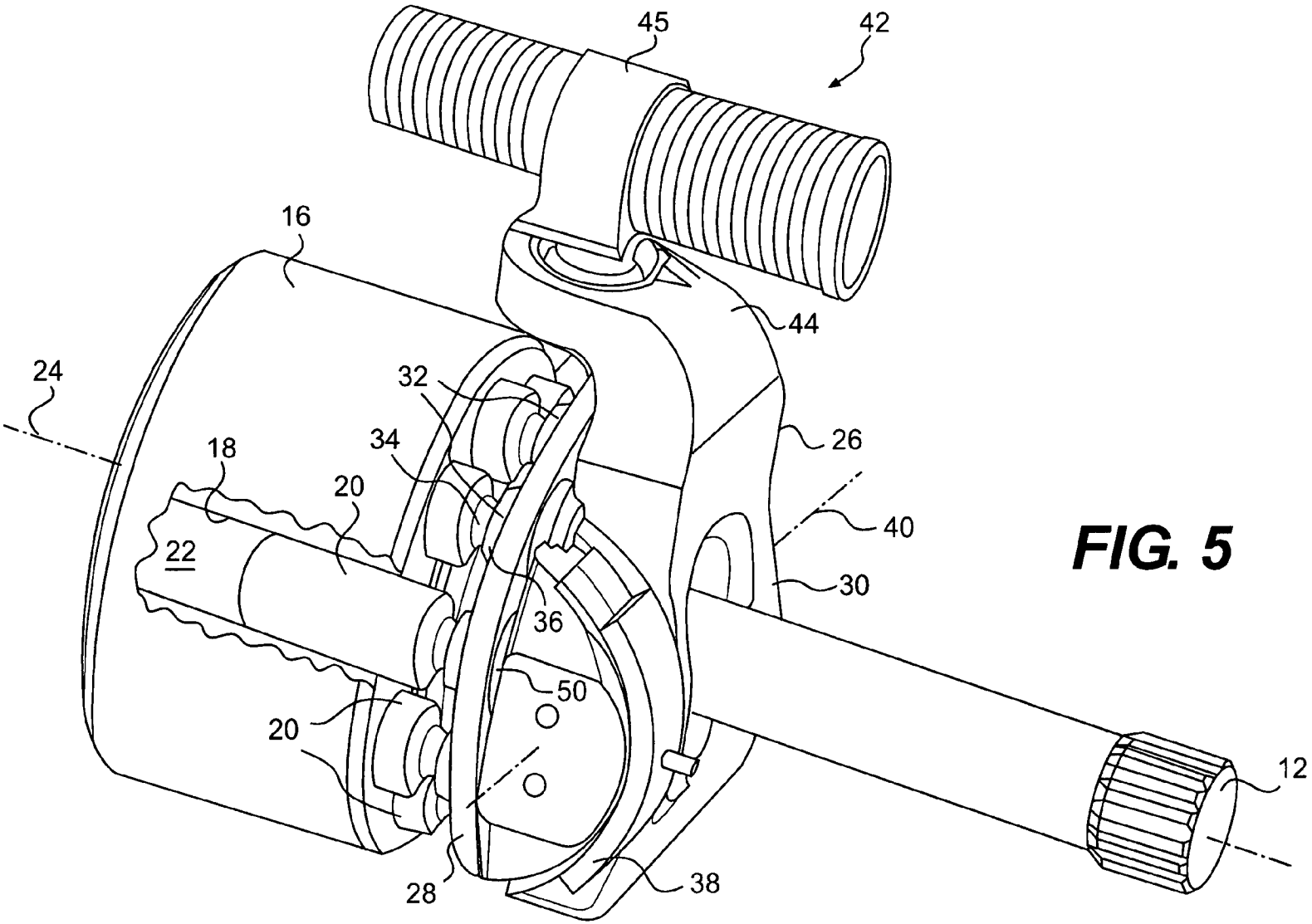
FIG. 5 is a diagrammatic illustration of an exemplary disclosed pump.

FIG. 5 illustrates yet another embodiment of swashplate 26. In this embodiment, the movement of undulations 46 may be imitated during operation of pump 10, rather than permanent physical features of swashplate 26. Specifically, in the embodiment of FIG. 5, swashplate 26 may include one or more undulation actuators 50 positioned at strategic annular locations between wear plate 48 and tiltable base 30. Actuators 50 may embody high-speed electronic actuators, for example piezo-type actuators, that are selectively energized to separate a portion of wear plate 48 from tiltable base 30 (i.e., to imitate the crests and/or troughs of undulations 46). The separation created by actuators 50 may function to selectively raise and lower plungers 20 at specific times and by specific amounts determined and at specific annular locations to attenuate the flow pulsations of pump 10 in a manner similar to the physical undulations 46 of plunger engagement surface 28 from FIGS. 1-4 (i.e., actuators 50 may induce the same number of undulations at the same timings, in the same amounts, and at the same locations as in the embodiments of FIGS. 1-4 during a single rotation of body 16). Further, because actuators 50 may be energized at different times, by different amounts, and/or at different locations, the range of flow pulsation attenuation provided thereby may even be greater than that provided by the physical undulations 46. That is, the attenuation provided by actuators 50 may be effective for a broad range of plunger displacements and pump speeds because the timing, amplitude, and/or locations may be selectively modulated.

Figure 6:
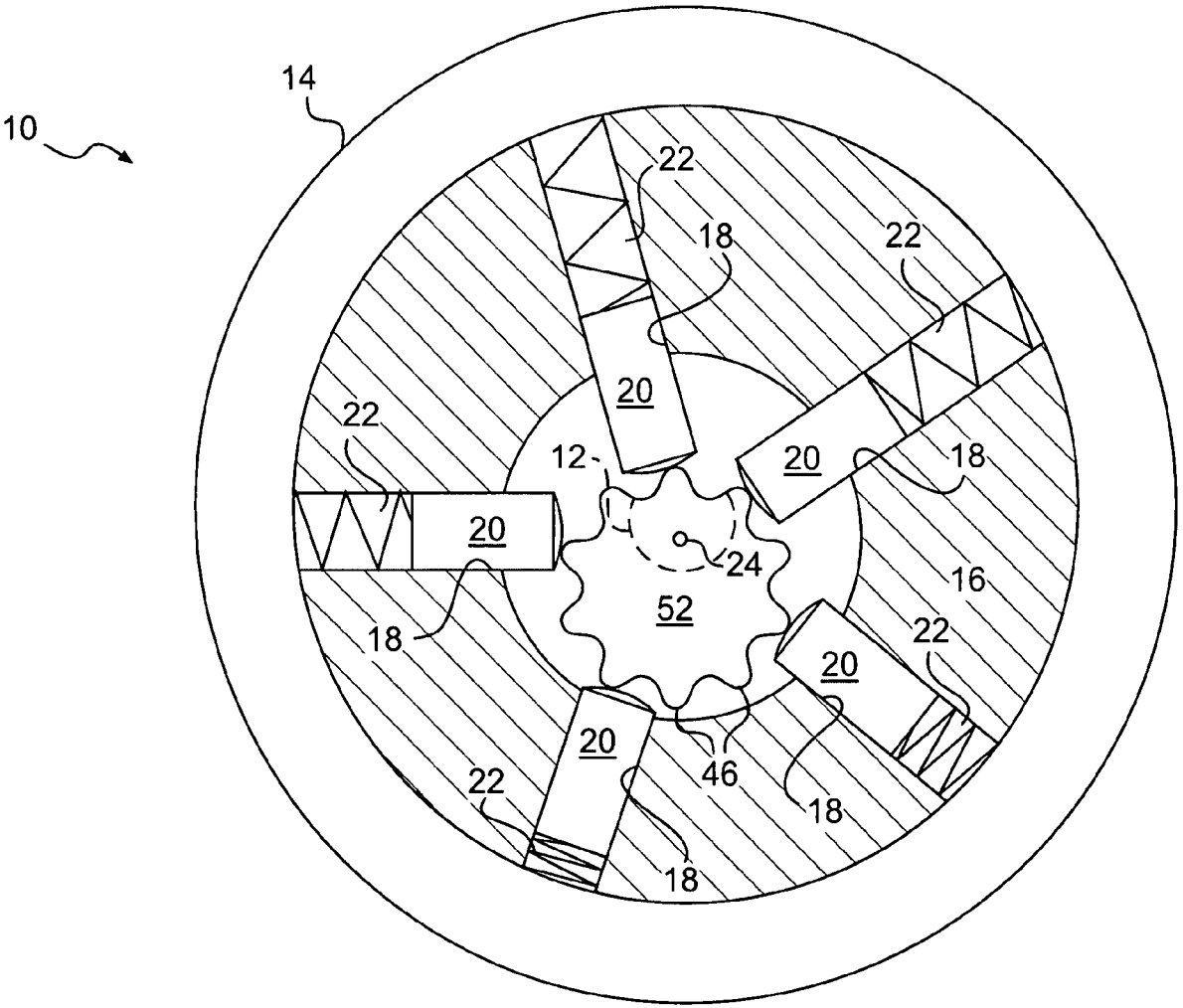
FIG. 6 is a diagrammatic illustration of an exemplary disclosed pump.

FIG. 6 illustrates another alternative embodiment of pump 10. In this five-plunger embodiment, plungers 20 may be oriented at right angles relative to driveshaft 12 (i.e., pump 10 of FIG. 6 may be a rotary-type pump). In this embodiment, plungers 20 may be driven by way of a stroke ring 52 or other similar geometry that is connected in an offset manner to an end of driveshaft 12, rather than by a swashplate. As such, as driveshaft 12 rotates about central axis 24, stroke ring 52 may cause individual plungers 20 to reciprocate into and out of their respective barrels 18. Plunger engagement surface 28 having undulations 46, similar to those of FIGS. 1-4, may be located on an outer periphery of stroke ring 52, such that flow pulsations of pump 10 may be reduced in the same manner described above.

Industrial Applicability

The disclosed pump finds potential application in any fluid system where stability and noise may be of concern. The disclosed pump finds particular applicability in hydraulic tool systems, especially hydraulic tool system for use onboard mobile machines. One skilled in the art will recognize, however, that the disclosed pump could be utilized in relation to other fluid systems that may or may not be associated with hydraulically operated tools. For example, the disclosed pump could be utilized in relation to an engine lubrication, cooling, or fueling system.

Referring to FIG. 2, when driveshaft 12 is rotated, body 16 and plungers 20 disposed within barrels 18 of body 16 may also rotate. As plungers 20 rotate about central axis 24, spherical ends 34 thereof, riding along tilted plunger engagement surface 28 may cause plungers 20 to cyclically rise and fall in the axial direction of driveshaft 12 (i.e., to extend into and retract from barrels 18). This reciprocating motion may function to draw fluid into pumping chambers 22 and push the fluid from pumping chambers 22 at an elevated pressure.

During operation of pump 10, the flow rate and/or pressure of the fluid exiting body 16 may be varied to meet demands of the associated circuit (not shown). To increase the flow rate and/or pressure of the discharged fluid, the tilt angle of plunger engagement surface may be increased, by moving actuator 42 in the first direction away from the input end of driveshaft 12. Conversely, to decrease the flow rate and/or pressure of the discharged fluid, the tilt angle may be reduced by moving actuator 42 in the second direction opposite the first.

As plungers 20 move across undulations 46, the travel of plungers 20 may be instantaneously changed by small amounts (i.e., increased as plungers 20 move across the crests of undulations 46, and decreased as plungers move across the troughs of undulations 46). This timing and magnitude of these instantaneous travel changes may function to attenuation the flow pulsations of pump 10.

Because of undulations 46, the flow output of pump 10 may be stabilized. And, this stabilization may be observed in more consistent operation of the system employing pump 10, as well as a reduced amount of noise from pump 10. Further, stabilization in the flow output of pump 10 may result in longer component life of pump 10 and of the associated hydraulic system.

It will be apparent to those skilled in the art that various modifications and variations can be made to the pump of the present disclosure. Other embodiments of the pump will be apparent to those skilled in the art from consideration of the specification and practice of the pump disclosed herein. It is intended that the specification and examples be considered as exemplary only, with a true scope being indicated by the following claims and their equivalents.

What is claimed is:

1. A pump, comprising:

a housing;

a rotatable body disposed within the housing and at least partially defining a plurality of barrels;

a plurality of plungers associated with the plurality of barrels;

a plunger engagement surface engaging the plungers;

a base to which the plunger engagement surface is mounted, the base having a tilt axis about which the plunger engagement surface tilts;

an actuator tilting the base such that the plurality of plungers reciprocate within the plurality of barrels as the rotatable body rotates; and geometry on the plunger engagement surface, wherein the rotatable body rotates the plurality of barrels and the plurality of plungers relative to the plunger engagement surface, and the geometry is such that undulations are present which enhance the reciprocation of the plurality of plungers and thereby reduce a flow pulsation of the pump, and wherein a number of the undulations present in the reciprocation of the plurality of plungers per rotation of the rotatable body is two times a number of the plurality of plungers when the number of the plurality of plungers is odd, and is equal to the number of the plurality of plungers when the number of the plurality of plungers is even.

2. The pump of claim 1, wherein the plunger engagement surface is formed as part of a swashplate.

3. The pump of claim 2, wherein the plunger engagement surface is integral with the swashplate.

4. The pump of claim 2, wherein the swashplate includes the base and a separate wear plate having the plunger engagement surface.

5. The pump of claim 1, wherein the geometry is configured to reduce the first three harmonics of the flow pulsation.

6. The pump of claim 1, wherein a magnitude of the undulations is related to at least one of a number of the plurality of plungers, a displacement of the plurality of plungers, or a speed of the pump.

7. The pump of claim 1, wherein a magnitude of the undulations is substantially smaller than a magnitude of the reciprocation of the plurality of plungers.

8. A pump, comprising:

a housing;

a rotatable body disposed within the housing and at least partially defining a plurality of barrels;

a plurality of plungers associated with the plurality of barrels;

a swashplate disposed within the housing and being tiltable to move the plurality plungers to vary a displacement of the plurality of plungers within the plurality of barrels;

a plunger engagement surface disposed between the swashplate and the plurality of plungers;

a first actuator tilting the swashplate to move the plurality of plungers to vary the displacement of the plurality of plungers within the plurality of barrels as the rotatable body rotates; and at least a second actuator located between the swashplate and the plunger engagement surface to selectively separate a portion of the plunger engagement surface from the swashplate and induce undulations in the plunger movement that reduce a flow pulsation of the pump, as the rotatable body rotates, the second actuator inducing twice the number of undulations in the plunger movement as a number of the plurality of plungers per rotation of the rotatable body when the number of the plurality of plungers is odd, and inducing the same number of undulations in the plunger movement as the number of the plurality of plungers per rotation of the rotatable body when the number of the plurality of plungers is even.

9. The pump of claim 8, wherein the second actuator is a high-speed electronic actuator that, when energized, separates the portion of the plunger engagement surface from the swashplate and induces the undulations.

10. A swashplate for a pump having a plurality of plungers, comprising:

a plunger engagement surface engaging the plurality of plungers;

a base having a tilt axis about which the plunger engagement surface is tiltable to move the plurality of plungers to vary a displacement of the pump;

an actuator actuating the base to move the plurality of plungers to vary the displacement of the plurality of plungers;

a plurality of crests and troughs formed on the plunger engagement surface configured to induce undulations in the displacement of the plurality of plungers and thereby reduce a flow pulsation of the pump, wherein a magnitude of the undulations in the displacement of the plurality of plungers induced by the plurality of crests and troughs is substantially smaller than a magnitude of the varying displacement of the plurality of plungers resulting from the actuator actuating the base.

11. The swashplate of claim 10, wherein the plunger engagement surface is formed integral with the base.

12. The swashplate of claim 10, further including a wear plate separate from the base, wherein the plunger engagement surface is formed on the wear plate.

13. The swashplate of claim 10, wherein the crests and troughs induce twice as many undulations in the displacement of the plurality of plungers per cycle of the pump as a number of the plurality of plungers when the number of the plurality of plungers is odd, and induce the same number of undulations in the displacement of the plurality of plungers per rotation of the pump as the number of the plurality of plungers when the number of the plurality of plungers is even.

14. The swashplate of claim 10, wherein the undulations induced by the crests and troughs are configured to reduce the first three harmonics of the flow pulsation.

15. A pump, comprising:

a housing;

a rotatable body disposed within the housing and at least partially defining a plurality of barrels;

a plurality of plungers associated with the plurality of barrels;

a base disposed within the housing and being tiltable to move the plurality plungers to vary a displacement of the plurality of plungers within the plurality of barrels;

a plunger engagement surface disposed between the base and the plurality of plungers;

a first actuator actuating the base such that the rotatable body rotating moves the plurality of plungers to vary the displacement of the plurality of plungers within the plurality of barrels; and at least a second actuator located between the base and the plunger engagement surface to selectively separate a portion of the plunger engagement surface from the base and induce undulations in the variation of the displacement of the plurality of plungers that reduce a flow pulsation of the pump, as the rotatable body rotates, wherein a magnitude of the undulations in the displacement of the plurality of plungers induced by the second actuator is substantially smaller than a magnitude of the variation in displacement of the plurality of plungers resulting from the first actuator actuating the base.

16. The pump of claim 15, wherein the plunger engagement surface is formed as part of a swashplate.

17. The pump of claim 16, wherein the plunger engagement surface is integral with the swashplate.

18. The pump of claim 17, wherein the swashplate includes the base and a separate wear plate having the plunger engagement surface.

* * * * *